United States Patent [19]

Koch

[11] 4,079,823

[45] Mar. 21, 1978

[54] COIN-OPERATED LOCKING DEVICE

[75] Inventor: Evaristo Koch, St. Gall, Switzerland

[73] Assignee: K. Schwizer AG, Gossau, Switzerland

[21] Appl. No.: 767,480

[22] Filed: Feb. 10, 1977

[30] Foreign Application Priority Data

Feb. 18, 1976 Switzerland ..... 2008/76

[51] Int. Cl.[2] ..... G07F 17/12

[52] U.S. Cl. ..... 194/54; 194/65

[58] Field of Search ..... 194/67, 51, 18, 19, 194/45, 54, 65

[56] References Cited

U.S. PATENT DOCUMENTS 1,924,533 8/1933 Babson ..... 194/45

3,976,178 8/1976 Koch et al. ..... 194/67

*Primary Examiner*—Stanley H. Tollberg

*Attorney, Agent, or Firm*—Flynn & Frishauf

[57] ABSTRACT

To improve the reliability and simplify the construction of a coin-operated locking device, and the associated key, a release element extending into a coin chute is formed as a double-armed lever, one arm of the lever being engageable by an inserted key and the other arm engaging a cylinder, or other locking element, to permit release of the locking element and operation thereof when a key tips the lever; the lever is located at a zone of the lock which is not normally engaged by a key, a master key, however, with an extension, permitting engagement of the other arm of the lever and thus also release the lock without insertion of a coin.

10 Claims, 4 Drawing Figures

COIN-OPERATED LOCKING DEVICE

Cross reference to related patent, over which the present application is an improvement: U.S. Pat. No. 3,976,178, KOCH et al.

The present invention relates to a coin-operated lock, and more particularly to a coin-operated lock of the type described and claimed in U.S. Pat. No. 3,976,178, of which the present inventor is a co-inventor.

The referred-to cross-referenced Pat. No. 3,976,178, KOCH et al, describes a locking device which is so arranged that a locking bolt can be brought into locked condition only after a coin has been inserted into a coin slot. The coin additionally acts on a release lever which permits unlocking of the lock with a key. A coin holding element prevents falling down of the coin when in a first position, permitting removal of the key, and locking of the lock, the coin then being released for fall under gravity, and subsequent collection, when the lock is again operated to open condition. Locks of this type are used, for example, with storage lockers and the like which permit withdrawal of a key only after a coin has been inserted and subsequent collection of the coin, or return of the coin after the key is again inserted. The coin may represent money to be collected for use of the locker; or it may represent a deposit as security for the key. The coin may be of any type, for example national currency, a token, or the like.

It is an object of the present invention to improve the lock described in the aforementioned patent, and particularly to simplify the structure thereof while increasing the reliability of operation.

SUBJECT MATTER OF THE PRESENT INVENTION

Briefly, the lock includes a release element which, in accordance with the present invention, is a pivotable lever, located to pivot with respect to the cylinder of the lock. The lever is a double-armed lever, one arm extending into the chute for the coin and deflected to release the lock cylinder so that it can be operated; the other arm engages the lock cylinder, unless engaged by a coin so that, unless a coin is inserted, the cylinder of the lock is prevented from rotation. The lever, preferably, is so located on the cylinder that normally it is beyond the reach of the ordinary key; if, however, a master key or the like is inserted into the cylinder, of longer length than the ordinary key, then the second arm of the lever is engaged to release the lever and still permit operation of the lock, even though no coin has been inserted.

Use of the lock by means of a master key permits operation thereof by supervisory personnel or, for example, permits the issuance of season passes to certain users by issuing those keys, so that they can operate the locks at all times, without introduction of coins therein. The lock of the aforementioned patent also had this capability; the structure of the present invention improves the reliability thereof while additionally simplifying the lock structure. Additionally, it permits the use of commercial cylinder-type locks having flat shanks, so that ordinary type locks and ordinary type keys can be used with but little modification.

DRAWINGS: ILLUSTRATING AN EXAMPLE:

Figure 3:
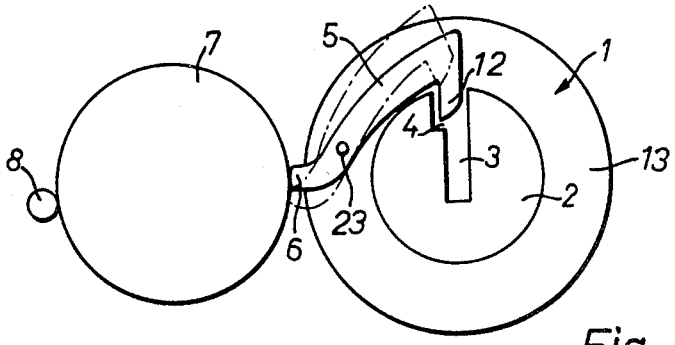
FIG. 3 is a fragmentary schematic cross-sectional view, looking at the end of the lock, with the release element engaged by a coin.
Figure 4:
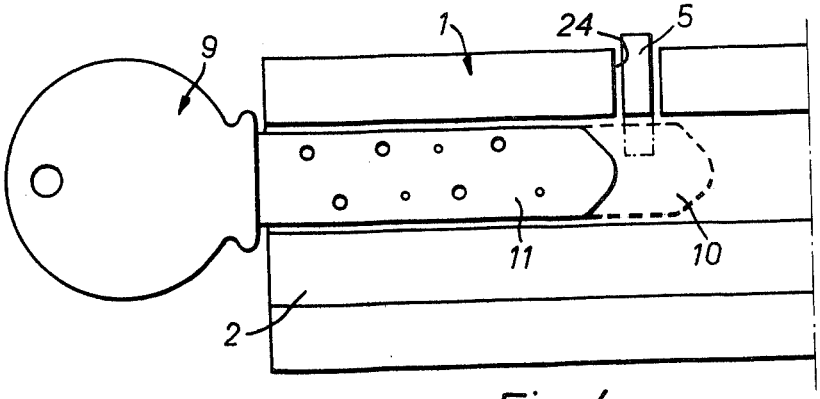
FIG. 4 is a longitudinal lengthwise cross-sectional slit view through the lock, with a key inserted.

The front plate 20 (FIG. 1), customarily made of sheet metal, is located in a suitable cut-out of a door to be locked, for example the door of the locker, a luggage storage compartment, or the like. A coin slot 15 is formed in the inside of the door, communicating with an upwardly open coin insertion slot 14. The coin channel 15 is arcuate, so that a coin, token, or the like, inserted through slot 14 travels through an arcuate path. A cylinder lock 1, of customary construction, penetrates through the front plate of the door and is secured thereto by any well-known means, for example by a clamping nut. The cylinder lock is externally accessible and operable by a key 9 (FIG. 4). The cylinder lock 1 includes a stationary cylinder 13 (FIG. 3) and an interiorly located rotor 2 which can be rotated when a suitable fitting key 9 is inserted therein, that is, if the tumblers (not shown) of the rotor are placed in unlocking condition by engagement with the suitably matching elements on key 9. The lock 1, thus, is of well-known, commercial type. The lock 1 is so constructed that the key 9 can be removed only when the lock is in closed position. When the lock is in open position, and in intermediate positions, the key is retained in the lock and prevented from removal thereof, for example by engagement of a notch formed in the key with a suitable projection interiorly of the lock as is well known in the art.

In accordance with the invention, and in addition to the tumblers (not shown) of lock 1, an essentially S-shaped double-armed one-piece lever 5 is proveded. Lever 5 is pivotally secured to the cylinder 13 (see FIG. 3) in a slot 24. Lever 5 can pivot about pin 23 in the cylinder 13. The pin 23 extends substantially parallel to the axis of the rotor 2. The lever 5, forming a release element, has unequal lever arms which have the tendency to engage the rotor 2 as seen in FIG. 3, that is, to hold the rotor 2 in locked, immovable position. As seen in FIG. 3, solid line, rotation of rotor 5 is blocked when the lever 5 is in engaged position. The end 6 of the double-armed lever 5 extends into the coin channel 15 at a place which is approximately in a horizontal plane extending through the axis of the rotor. In combination with a retaining pin 8, it blocks dropping of a coin 7 which has travelled downwardly through channel 15. The distance between pin 8 and the inner end of the arm 6 is dimensioned to be slightly less than the coin with which the lock is to be used. The other, longer end 12 of the double-armed locking lever 5 terminates in a hook-like end extension, which penetrates through an enlarged opening 4 into the inner end of the key slot 3. In the absence of a coin 7, the vertically extending hook-shaped portion 12, engaging in opening 4 of the key slot 3, prevents rotation of rotor 2, even if a matching key 9 is inserted therein.

Figure 1:
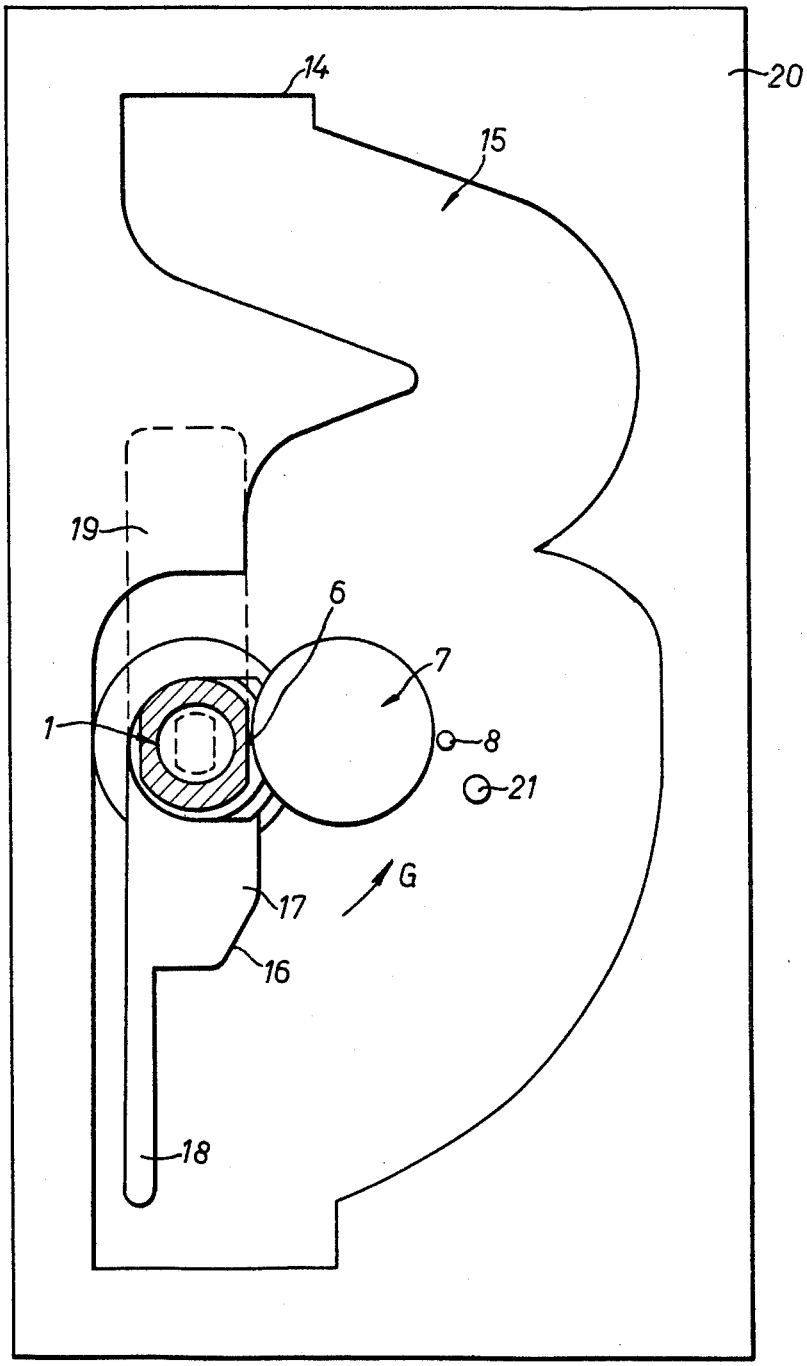
FIG. 1 is a schematic vertical plan view of the base plate at the inside of a door, with the front removed, and the lock in open position.
Figure 2:
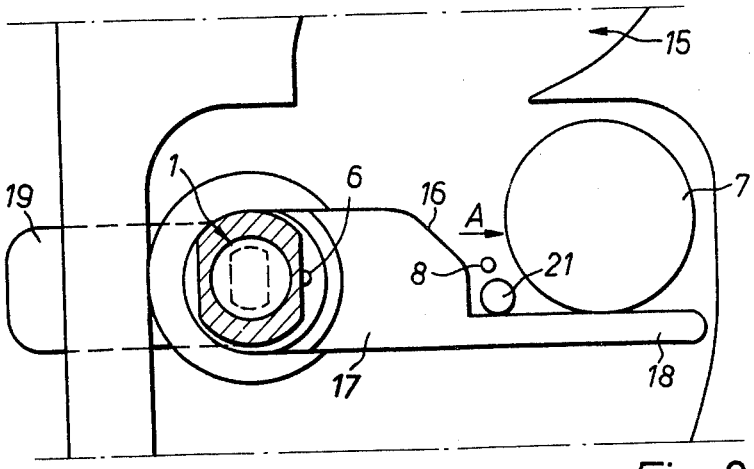
FIG. 2 is a fragmentary view of a portion of the plate of FIG. 1, with the lock in locked condition.

Upon insertion of a coin 7, the lever 5 is pivoted to the chain-dotted position (FIG. 3). This removes the hook-shaped end 12 from the slit 4 of the rotor, by lifting it out of the slit, thus freeing the rotor 2 to rotate if the proper key 9 is inserted. Rotor 2 can now be turned by means of its associated key 9 and the locking bolt 19 can be moved to locked position (compare FIGS. 1 and 2). The key now can be removed, since the lock is in locked position, and the door is locked. Rotating the rotor from open to locked position has an additional effect: The portion of the end 6 which extends into the space between the pin 8 and the lock is lifted by finger 18. This moves the coin 7 into the region of an inclined shoulder 16 of lever 17 (FIGS. 1, 2). The inclined surface first causes lifting of the coin 7 and thereafter permits movement of the coin in the direction of the arrow. A (FIG. 2) to move the coin into a lateral recess of the coin chute 15. Pin 21 limits the pivoting movement of the finger 18 when being turned in the direction of the arrow G (FIG. 1). The position of the coin 7 will remain that illustrated in FIG. 2. Coin 7 is retained by the end portion, that is, the projecting finger 18 of the lever 17.

If the door is to be opened again, key 9 is inserted into the lock. The locking bolt is thus moved into the unlocked position. Upon this unlocking movement, finger 18 releases coin 7 so that it will be inserted into the subsequently following ejection chute. Coin 7 can be returned to the user as a deposit coin, or it can be collected as a use charge and guide to a suitable coin reservoir.

The lock can be operated without insertion of a coin or token; if, for example, supervisory personnel should wish to open the lock, or close the lock, a separate master or pass key is used which is identical to the key 9 except that the shaft 11 is formed with an extension 10, shown in broken lines in FIG. 4. The pass key has the same key code formed thereon as the key with which the lock is to be associated, except that the extension 10 permits engagement with the hook-shaped end 12 of lever 5. This engagement lifts the hook 12 out from the slit 4 of the rotor 2, and the rotor 2 can now be rotated, without insertion of the coin, with the master key. The locking bolt must necessarily be moved to open position, which ensures continued insertion of the key, since the key will be prevented from removal. The key can be removed, again, only if the lock is brought into locked condition.

Further details of the lock structure are disclosed in the aforementioned cross-reference patent, the disclosure of which is hereby incorporated by reference.

Various changes and modifications may be made within the scope of the inventive concept.

I claim:

1. Coin-operated locking device having a lock unit (1, 2) including a locking bolt (17, 19) and a lock rotor (3) operating the bolt which can be moved by a key (9) between locked and unlocked position;

a coin chute (14, 15) and a coin retaining means (8) arranged to retain an inserted coin (7) in a first position;

a lever (17) associated with the bolt (19) and arranged to release a retained coin (7) only after movement of the bolt (19) from locked position to an opening position thereof;

said lever (17) being formed with a deflection surface (16) facing a coin in retained position for deflection of the coin from the retained position, upon movement of the bolt (19) and hence the lever (17) to a second position preparatory to release of the coin;

and a release element (5) movable to release position by means of an inserted coin to release the bolt (19) and permit movement of the bolt into locking position, the release element cooperating with the movable lock rotor (2), wherein, in accordance with the invention, the release element comprises a double-armed lever (5) pivotally located to pivot relative to the cylinder (13) of the lock, one end (6) of the double-armed lever extending towards an inserted coin located in a coin chute (15), the other end (12) of the double-armed lever cooperating in locking, and unlocking relationship with the rotor (2) of the lock (1).

2. Device according to claim 1, wherein the release lever is located to engage the rotor (2) of the lock in a region of the key slot (3) of the lock to permit operation of the release lever by a master key engageable with said release lever at said position.

3. Device according to claim 1, wherein the release lever is pivotable about an axis which is parallel to the axis of rotation of the rotor (2) of the lock, the release lever being pivoted to the rotor at a position to provide for engagement of the one arm (12) with the rotor by gravity, or weight of said one arm with the rotor, and to lock the rotor against rotation.

4. Device according to claim 1, wherein the arm of the lever engageable with the rotor (2) is formed with a downwardly directed hook (12);

and said rotor is formed with an enlargement (4) of the key slot (3) thereof, the hook (12) of said double-armed lever engaging in the enlargement of the key slot.

5. Device according to claim 1, wherein the locking lever (5) is essentially S-shaped;

and a pivot pin (23) is located off center with respect to said S-shaped lever and pivoting the S-shaped lever to a stationary part (1) of lock unit (1, 2).

6. Device according to claim 1, wherein said lock unit (1, 2) is a cylinder lock.

7. Device according to claim 5, wherein said lock unit (1, 2, 13) is a cylinder lock, and said pivot pin (23) pivots and release lever (5) on a stationary cylinder (13) of said lock.

8. Coin-operated locking device having a lock unit including a stationary lock part (13) and a lock rotor (3) pivotally supported in said stationary lock part (13) and having a key slot (3) a locking bolt (17, 18) which can be moved by the lock rotor (3) after moved by the lock rotor (3) after inserting of a key (9) between locked and unlocked position;

a coin chute (14, 15) and a coin retaining means (8) arranged to retain an inserted coin (7) in a first position;

and a release element (5) movable between a release position and a locking position in which locking position the release element engages the lock rotor (2), wherein the release element (5) comprises a double-armed one-piece lever (5) pivotally located to pivot relative to said stationary lock part (13) one end (6) of the double-armed lever (5) extending towards said coin retaining means (8) the other end (12) of the double-armed lever (5) cooperating in locking and unlocking relationship with the key slot (3, 4) of said lock rotor (2), said release lever (5) is located to engage the lock rotor (2) in a region of the key slot (3) to permit operation of the release lever (5) by a master key engageable with said release lever at said position, to thereby enabling optional pivoting the release lever (5) by an inserted coin or by a master key into the release position.

9. Device according to claim 8, wherein the release lever (5) is penetrating a slot (24) in said stationary lock part (13), a pin (23) pivotally holding said release lever (5), said pin (13) extends substantially parallel to the axis of rotation of said lock rotor (2) and is located in said stationary lock part (13).

10. Device according to claim 8, wherein said one end (6) of the double-armed lever (5) is approximately in a horizontal plane extending through the axis of the lock rotor (2) and said other end (12) has a hook-like extension extending substantially in vertical direction in the locked position.

* * * * *